US005221050A

United States Patent [19]

Jeffries et al.

[11] Patent Number: 5,221,050

[45] Date of Patent: Jun. 22, 1993

[54] ELECTROSTATIC SPRAYER INCLUDING A FLEXIBLE CONTAINER

[75] Inventors: Andrew Jeffries, Pantymwyn; Michael L. Green, Nannerch; Timothy J. Noakes, Pantymwyn, all of Wales

[73] Assignee: Imperial Chemical Industries PLC, London, United Kingdom

[21] Appl. No.: 781,316

[22] Filed: Oct. 24, 1991

[30] Foreign Application Priority Data

Oct. 26, 1990 [GB] United Kingdom ..... 9023339

[51] Int. Cl.[5] ..... B05B 5/035; B05B 5/16; B05B 11/04

[52] U.S. Cl. ..... 239/708; 239/323; 239/327; 239/375; 239/690; 222/103; 222/386.5

[58] Field of Search ..... 239/320, 323, 327, 375, 239/690, 708; 222/386.5, 103

[56] References Cited

U.S. PATENT DOCUMENTS

| | | | |
|---|---|---|---|
| 2,159,894 | 5/1939 | Hines | 239/375 X |
| 2,629,516 | 2/1953 | Badham | 239/327 X |
| 4,577,803 | 3/1986 | Owen | 239/690 |
| 4,907,727 | 3/1990 | Ernst et al. | 222/386.5 |
| 5,105,984 | 4/1992 | Kazimir | 222/103 |

FOREIGN PATENT DOCUMENTS

| | | | |
|---|---|---|---|
| 868443 | 12/1978 | Belgium . | |
| 1542898 | 10/1968 | France | 239/327 |
| 2407168 | 5/1979 | France . | |
| 2127494 | 4/1984 | United Kingdom . | |

*Primary Examiner*—Andres Kashnikow
*Assistant Examiner*—William Grant
*Attorney, Agent, or Firm*—Cushman, Darby & Cushman

[57] ABSTRACT

Liquid to be dispensed is supplied to a dispensing nozzle (88) from a compressible container (30) such as a sachet with a valve-controlled outlet (66) by compressing the sachet through the agency of a pad (46) of resiliently deformable material. The dispensing device is embodied in a hand held unit having a trigger (102) and electrical circuitry (91, 96, 106, 98, 106) for applying high voltage to the liquid in order to effect dispensing of the liquid in the form of an electrostatically charged, atomised spray.

33 Claims, 6 Drawing Sheets

ELECTROSTATIC SPRAYER INCLUDING A FLEXIBLE CONTAINER

This invention relates to the dispensing of fluids, especially fluids contained in flexible walled containers such as sachets. Sachets are convenient containers for the storage and dispensing of fluids in many situations but are not readily amenable to the dispensing of fluids in a controlled manner.

According to one aspect of the present invention there is provided a device for dispensing fluids, comprising a housing for receiving a flexible fluid-containing container, the container being of the type which is operable to dispense its contents in response to being compressed, and means for compressing the container to feed fluid to a dispensing outlet of the device, said means for compressing the container comprising a pad of resiliently deformable material for bearing against the container and means for deforming said material to subject the container to compressive loading.

By applying a compressive load to the container through the agency of a pad of resiliently deformable material, it is possible to spread the load evenly over the flexible walled portion of the container.

Conveniently the container is in the form of a sachet.

Typically the container will have a pair of opposed flexibly deformable walls bonded together around peripheral margins of the walls. However, in some cases, the container may include a substantially rigid wall or a wall that is at least substantially more rigid than the flexible wall or walls thereof. The container is conveniently provided with a valve controlled outlet carried by one of its opposed walls at a location spaced inwardly from its peripheral edge(s).

Said surfaces are preferably relatively movable to vary the spacing therebetween so as to control the magnitude of the compressive load applied to the container.

User-operable means may be provided to allow selective variation in the extent of deformation of the pad and hence the applied compressive load so as to permit variation in the rate of dispensing of fluid from the container.

In some instances, the rate of dispensing of the fluid may be required to be substantially uniform irrespective of whether the container is full, nearly empty or in some intermediate state between full and empty and, in this event, the resiliently deformable material is advantageously selected to provide a substantially constant compression force over a predetermined range of deformation thereof, said means for compressing the material being arranged, when a filled container is present, to deform the pad to within said range such that, as the container empties and the pad expands, the pad remains within said range.

According to a second aspect of the invention there is provided a device for electrostatically spraying fluids, comprising a housing for receiving a flexible fluid-containing container, the container being of the type which is operable to dispense its contents in response to being compressed, a nozzle from which the fluid is to be sprayed in use, means for compressing the container to feed fluid to the nozzle and high voltage means for applying electrostatic potential to the fluid such that the fluid issues from the device in the form of an electrically charged spray, said means for compressing the container comprising a pad of resiliently deformable material for bearing against the container, and means for deforming said material to subject the container to compressive loading.

The resiliently deformable material typically comprises a foam material which may have an open or closed cell structure.

The flexible walled container conveniently comprises a valve controlled outlet which may be located at an edge of the container where the flexible walls are bonded together or at a generally central position with respect to one of the flexible walls. The outlet may be at least in part be composed of an electrically conductive material to provide electrical connection between the high voltage means and the liquid in the container.

The device is conveniently suitable for hand held use, the housing having a hand grip portion and an associated user-operable trigger forming part of said means for deforming the pad, the trigger being arranged so that the extent of deformation of the pad is variable to allow the rate of dispensing of the liquid to be selectively varied. The trigger may also be arranged to control the high voltage means in such a way that electrostatic potential is only applied to the liquid in response to operation of the trigger.

The high voltage means is typically constituted by an HT generator accommodated within the housing and, advantageously, the HT generator forms part of the means for deforming the pad in that it is mounted for movement in the housing and forms part of a drive train for translating operation of the trigger into a force for effecting deformation of the pad.

In one embodiment of the invention which is particularly suitable for applications of the invention requiring dispensing of the liquid at a substantially constant rate, the means for deforming the pad comprises a casing comprising a pair of casing parts which can be brought together to enclose the container therebetween, at least one of the casing parts being provided with a pad of resiliently deformable material For example, the casing parts may be hingedly connected for movement between an open and a closed position. The casing may also incorporate electrically conductive means for providing electrical connection between the high voltage means and the fluid.

Other features and aspects of the invention will become apparent from the following description and appended claims.

The invention will now be described by way of example only with reference to the accompanying drawings, in which.

Figure 1:
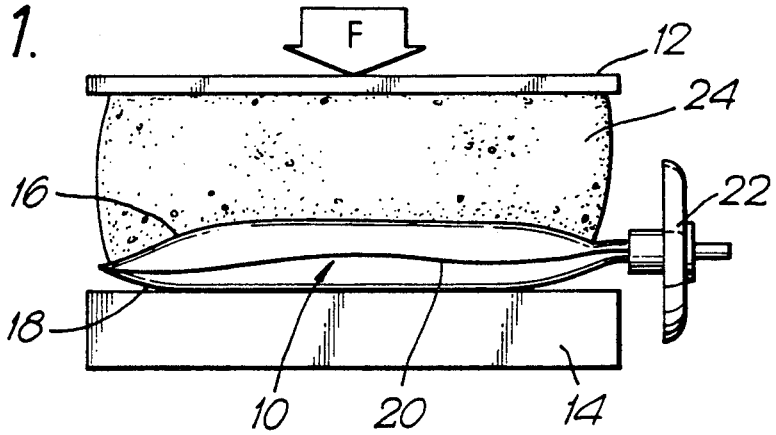
FIG. 1 is a diagrammatic view illustrating the principle of operation of a device in accordance with the invention.
Figure 2:
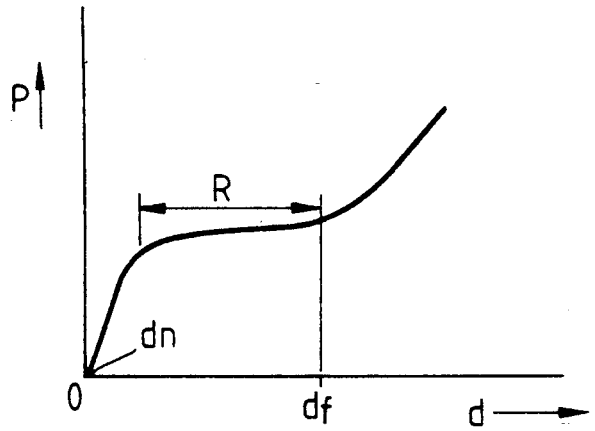
FIG. 2 is a schematic graph of deformation -v-pressure for material suitable in providing dispensing at a substantially constant rate.
Figure 3:
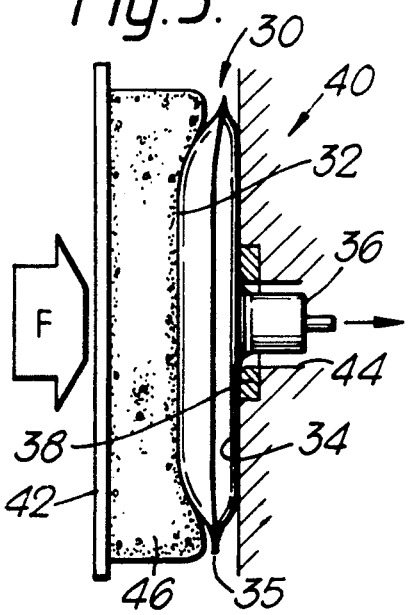
Figure 4:
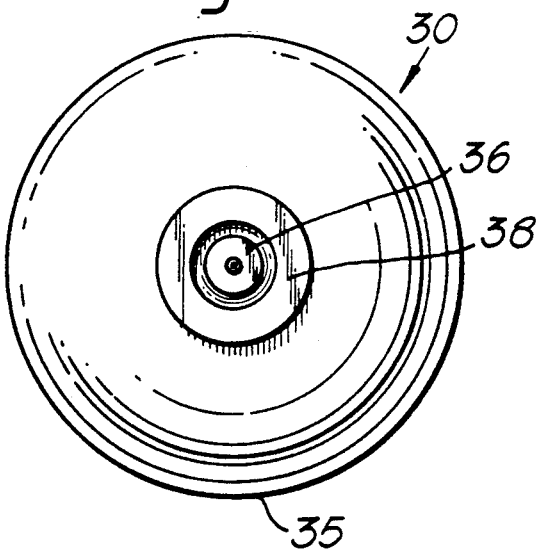
Figure 2A:
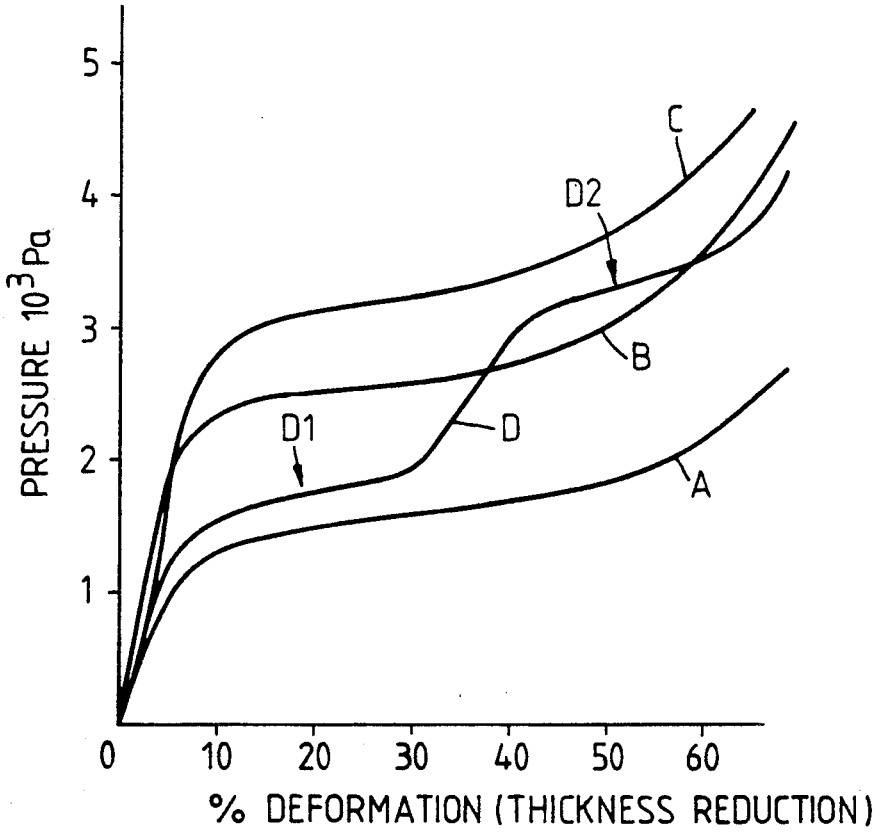
Figure 5:
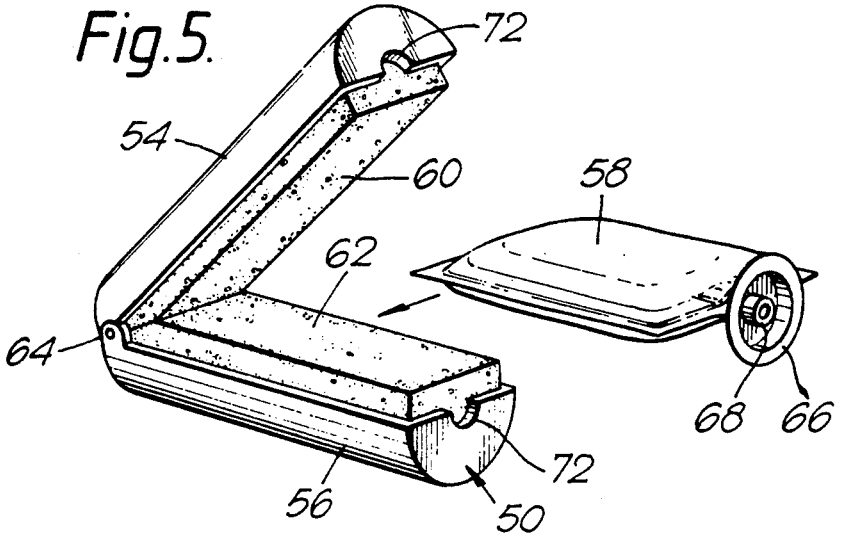
Figure 6:
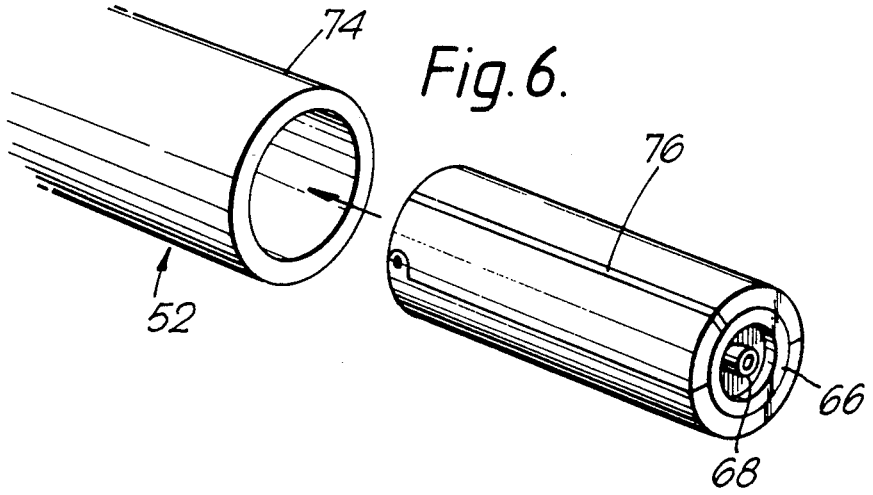
Figure 8:
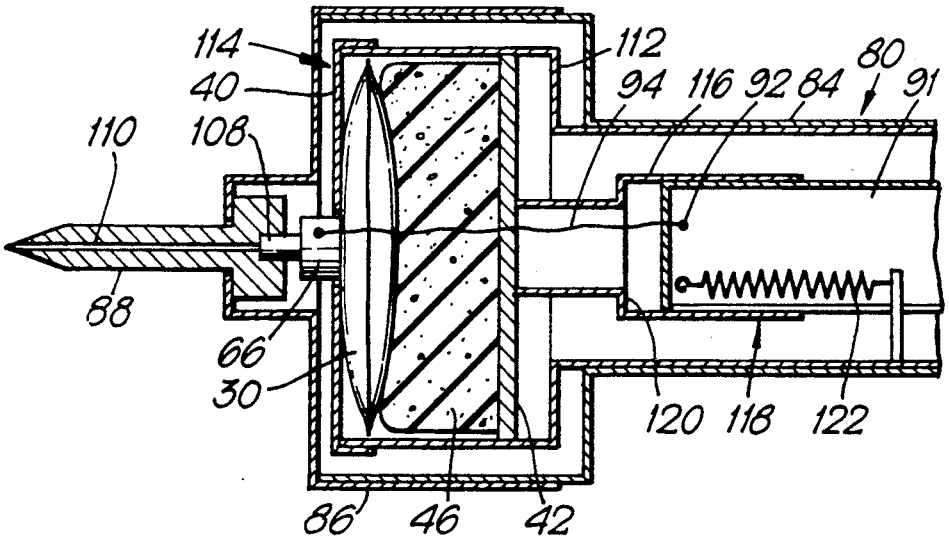
Figure 7:
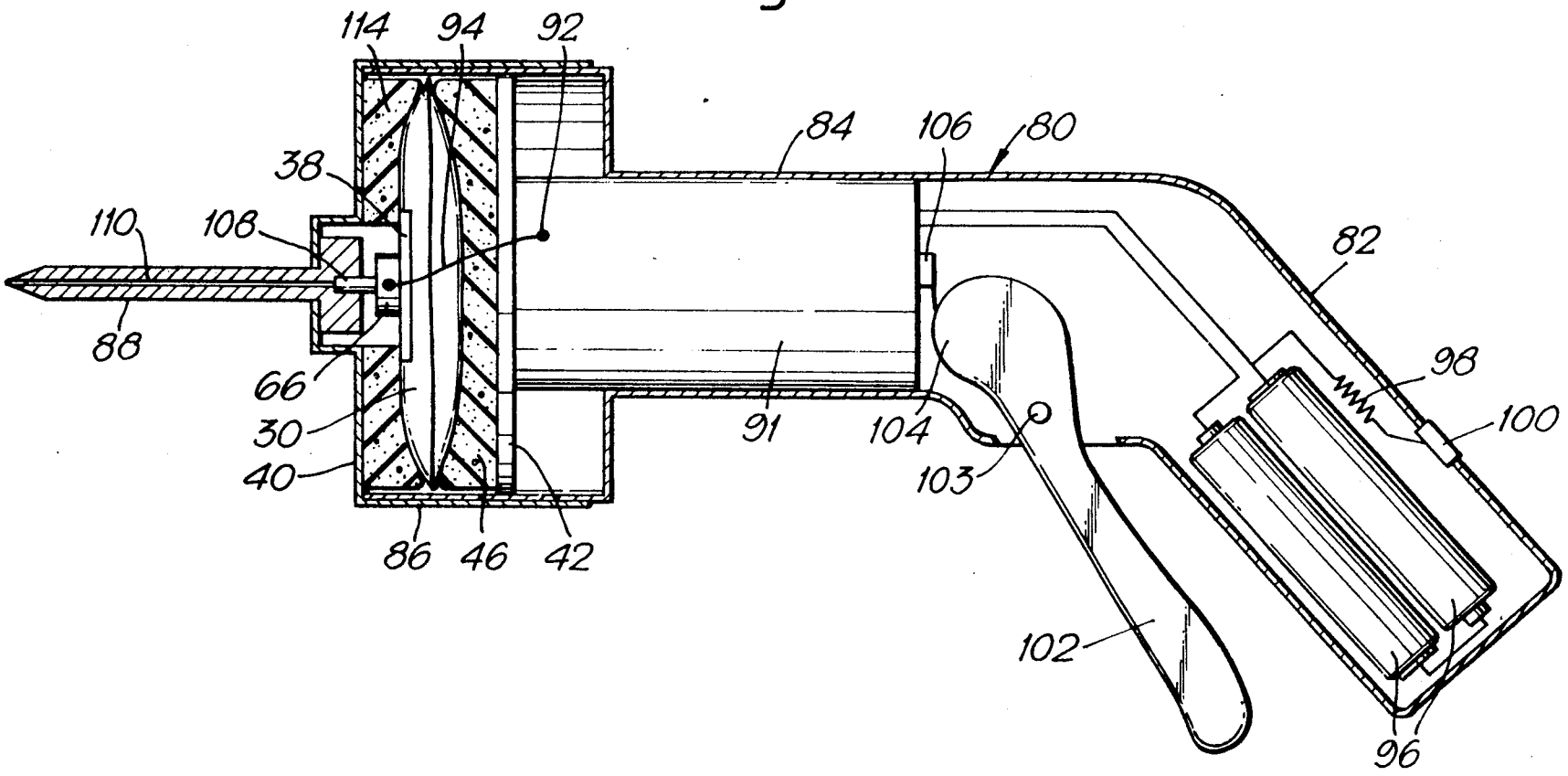
Figure 9:
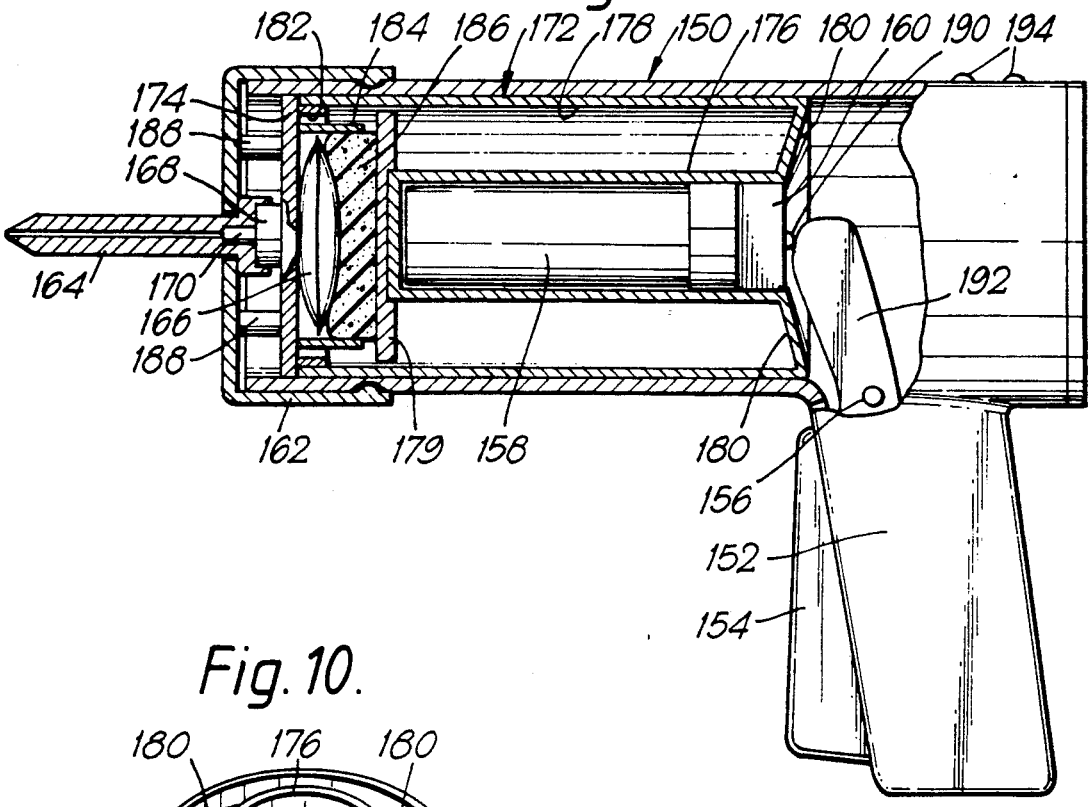
Figure 10:
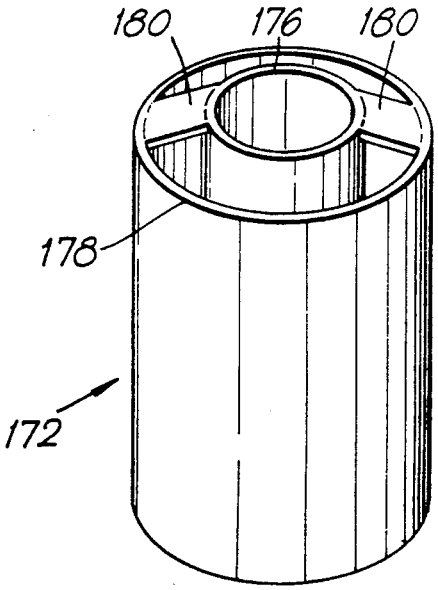
Figure 10A:
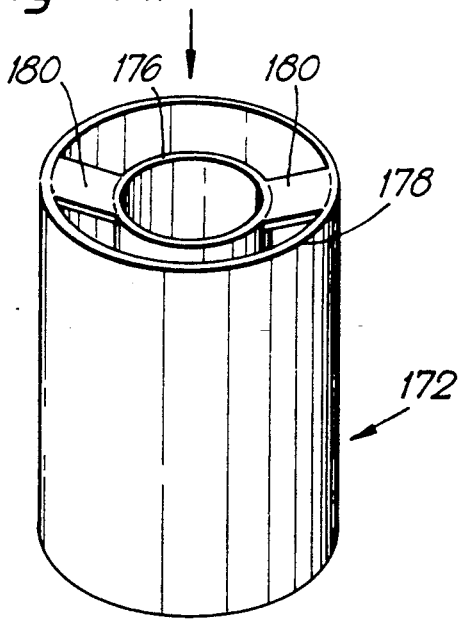
Figure 11:
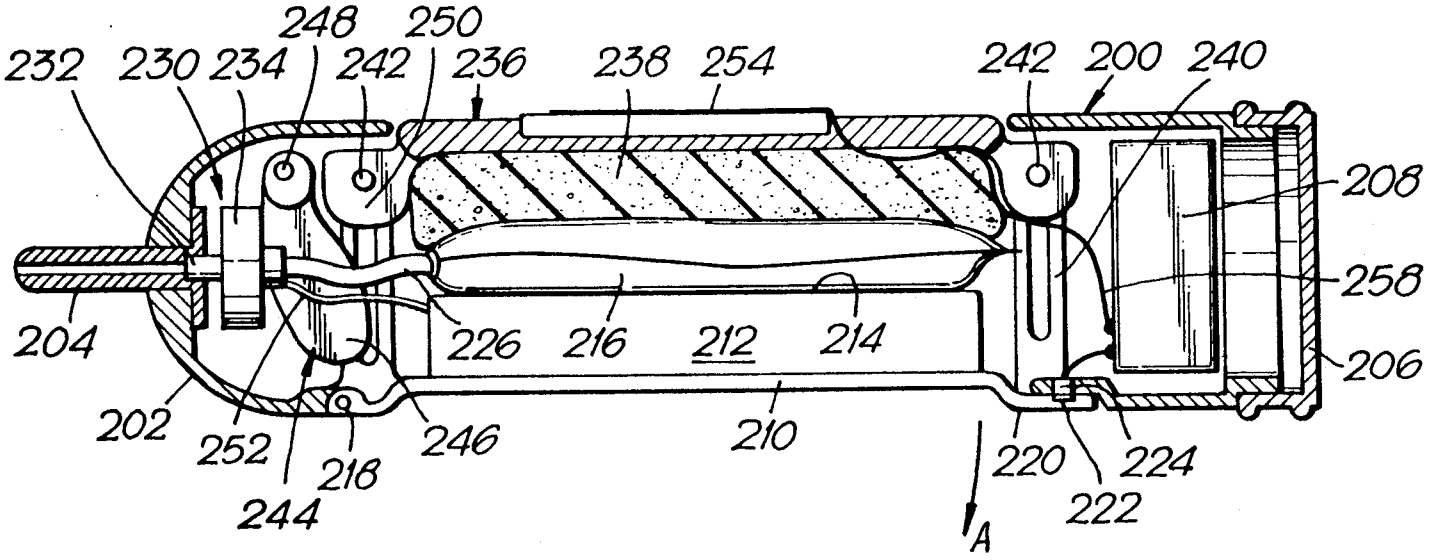

FIG. 2*a* is a graph showing the deformation -v-pressure curves for a number of foam material samples;

FIG. 3 is a view similar to FIG. 1 but showing a different form of container;

FIG. 4 is a front elevation of the container of FIG. 3;

FIG. 5 is an exploded schematic perspective view of a cartridge for use in an electrostatic spraying device;

FIG. 6 is a perspective view illustrating insertion of the cartridge of FIG. 5 into the housing of a spraying device;

FIG. 7 is a diagrammatic view showing one form of hand held electrostatic spraying device in accordance with the invention;

FIG. 8 is a diagrammatic view of a second form of hand held device in accordance with the invention;

FIG. 9 is a diagrammatic view, partly in section, of another embodiment of the invention;

FIGS. 10 and 10A are perspective views of a carrier forming part of the device shown in FIG. 9 in its unstressed and stressed conditions respectively; and FIG. 11 is a diagrammatic sectional view of another device embodying the invention.

Referring to FIG. 1, to effect dispensing of liquid contained therein a sachet 10 is located between upper and lower plates 12, 14 at least one of which is movable. The sachet 10 is defined by upper and lower generally rectangular layers 16, 18 of flexible sheet liquid impermeable material which are bonded together around their peripheral margins 20 and the sachet is provided with an outlet 22 which may be controlled by a spring-loaded valve in the manner of an aerosol nozzle. The liquid is contained in the unbonded generally rectangular region between the layers 16, 18, ie. within the area bounded by the bonded peripheral margins 20.

In this embodiment, the plate 12 is movable towards and away from the plate 14 by means of an unshown mechanism. At least one of the plates (12 in the illustrated embodiment) carries a pad 24 of resiliently deformable material, such as a foam rubber, which contacts the sachet 10 and is dimensioned so as to cover the liquid containing portion of the sachet. Compressive loading is applied to the sachet by moving the plate 12 towards the plate 14 which has the effect of compressing the pad 24 which, in turn, will deform in such a way as to conform with the shape of the sachet 10 and translate the force F acting on the plate 12 into pressure applied substantially uniformly over the liquid-containing portion of the sachet.

When the valved outlet 22 is open, as the liquid discharges from the sachet, the sachet-contacting face of the pad 24 will continue to conform to the shape of the liquid containing portion of the sachet as the latter changes The pressure to which the sachet 10 is subjected may vary according to the extent of deformation of the pad so that the rate of dispensing is varied. A suitable foam in this instance is a closed cell foam with good elastic properties, eg. an EVA copolymer foam having a density of 50 kg/m$^3$ such as that manufactured under the brand name "EVAZOTE" EV50. In some instances however, it may be desirable to maintain a substantially constant rate of dispensing irrespective of whether the sachet is full, near empty or in an intermediate condition. In this event, the material of which the pad 24 is composed is selected so that the pressure applied to the sachet remains substantially constant irrespective of the extent to which the pad is deformed.

FIG. 2 illustrates schematically the characteristics required of a material for this purpose. In the graph of FIG. 2, the ordinate d represents the extent to which the pad is deformed from its natural thickness dimension $d_n$ and the abscissa P represents the pressure to which the sachet is subjected as a result of such deformation. A material suitable for effecting dispensing at a substantially constant rate will exhibit a non-linear curve having a section R over which the rate of change of pressure P with respect to d is reduced compared with other sections of the curve.

It will be seen that by using a foam pad having a deformation-v-pressure characteristic as shown in FIG. 2, the pressure applied to the sachet may be relatively independent of the manner in which the operating mechanism for effecting foam compression is actuated since the device may be designed so that, irrespective of the force applied to actuate the operating mechanism, the pad is not compressed beyond the extremity $d_f$. In this way, the rate of dispensing fluid from the sachet may be made reasonably uniform for a range of actuating forces applied to the operating mechanism.

Also, by pre-loading the pad so that it is initially compressed to the point $d_f$ when the sachet is full and by selecting a material for which the range R is at least equal to the reduction in deformation that the pad undergoes in changing shape in conformity with the full and empty conditions of the sachet, it will be seen that (assuming the relative spacing between the plates 12 and 14 is maintained constant at the pre-load setting), the sachet will be subjected to a substantially constant pressure throughout the dispensing cycle, ie. from full to empty.

The curve shown in FIG. 2 illustrates an ideal case. In practice, the plateau may not be as well-defined or as shallow; nevertheless, a foam material will be suitable for many applications requiring substantially constant rate dispensing if it exhibits a plateau region in which the force remains reasonably constant over a range of compression/displacement of the foam. Also, many foams when compressed to a given extent will produce a force which decays with time and, especially in the case of applications likely to involve sustained spraying and hence compression of the foam, due regard must be given to the decay characteristics of the foam. For many spraying applications, e.g. personal care products such as deodorants and hair sprays. spraying is only sustained for a relatively short time, and hence the decay characteristics of the foam will not affect spraying significantly. The present invention may not however be suitable in applications where the foam is to be compressed or pre-compressed for relatively long periods of time because of the decay characteristics of foam materials. A suitable foam exhibiting appropriate behavior for use in many applications of the invention, especially personal care products, is an elastic open cell foam such as polyether foam.

FIG. 2A illustrates typical deformation-v-pressure curves for a number of grades of polyether foam. The curves A, B and C respectively correspond to polyether grades ET 14W, ET 22Y and ET 29G supplied by Foam Engineers Limited of High Wycombe, England, each sample being 50 mm thick (uncompressed) and having an area of 130 mm×50 mm. It will be seen that each sample exhibits a plateau region corresponding to the region R in FIG. 2. Thus, by appropriate selection of the grade of polyether, the pressure applied over the plateau region can be varied according to requirements. Curve D of FIG. 2A corresponds to a composite sample comprising a pad of grade ET 14W in superimposed relation with a pad of grade ET 29G. each pad being 25 mm thick and 130 mm×50 mm. In this instance, it will be noted that the curve exhibits a first plateau D1 and a second plateau D2. By using a composite pad, it will be appreciated that a device may be designed which can produce two (or more, depending on the number of superimposed layers within the composite pad) relatively uniform dispensing flow rates, the particular flow rate required being controlled for example by the application of appropriate force by the user so that the composite pad is compressed to an extent within range D1 or D2 as the case may be. The device may be provided with some form of indicator to enable the user to judge the pressure necessary to achieve one flow rate or the other.

In the embodiment of FIG. 1, the outlet 22 is located at one of the edges of the sachet 10. FIGS. 3 and 4 illustrate a modification in which the sachet 30 has its outlet 36 positioned generally centrally of one of the flexible generally circular, liquid impermeable layers 32, 34. In this embodiment, the sachet is shown as being of circular configuration although this is not essential, the layers 32, 34 being bonded together around their circumferential edges 35 and the outlet 36 having a flange 38 by means of which it is bonded to the layer 34. In this embodiment, the device comprises a fixed anvil 40 and a drive plate 42 between which the sachet is located with its outlet 36 received in an opening 44 in the anvil 40 and through which the liquid is discharged. A pad 46 of resiliently deformable material, which may if desired have a deformation -v-pressure characteristic curve as shown in FIGS. 2 and 2A is interposed between the sachet and the drive plate 42 and is deformed by movement of the drive plate 42 towards the anvil 40. As in the embodiment of FIG. 1, such deformation of the pad 46 results in the application of uniformly distributed compressive loading to the sachet to enable its contents to be dispensed.

It will be appreciated that the embodiment of FIGS. 3 and 4 may be arranged to operate to provide either variable rate dispensing of the liquid or relatively constant rate dispensing, as described in connection with the embodiment of FIG. 1.

In both embodiments, the components illustrated conveniently form part of a device including a holder and a user-operable mechanism for actuating relative movement of the plates 12, 14 or the plate 42 and the anvil 40. The mechanism may be so designed that operation of a trigger or the like by the user effects opening of the valve of the outlet before compression of the sachet or other flexible walled liquid container.

Referring now to FIGS. 5 and 6, this embodiment is primarily intended for operation in the manner described with reference to FIG. 2. A cartridge 50 is shown for use with an electrostatic spraying device, the housing 52 of which is illustrated in part. The cartridge 50 comprises a casing comprising two parts 54, 56 which are designed to be assembled together to enclose a flexible walled container 58 such as a sachet. At least one of the casing parts (preferably both) is provided with a pad 60, 62 of resiliently deformable material, such as a foam material, so that when the casing parts are assembled together in the manner shown in FIG. 6, the pads 60, 62 are compressed and thereby apply compressive loading to the sachet 58.

The casing parts 54, 56 may be hingedly connected at one end 64 so that they can be opened and closed as shown in FIGS. 5 and 6. Means (not shown) may be provided for fastening the parts 54, 56 together in the closed, compressed position; however, fastening means may not be necessary since the two parts can be held in the closed position when inserted into the housing 52 if the latter is dimensioned to receive the cartridge as a close fit. When the casing parts are in the closed position, the pads are pre-compressed in the manner described with reference to FIG. 2, eg. with the casing parts closed and a full sachet located between them, the pads may be compressed to the point $d_f$ indicated in FIG. 2 so that as the pads expand in response to emptying of the sachet, dispensing of the liquid is maintained at a relatively constant pressure.

As in the embodiments of FIGS. 1 to 4, the sachet 58 is provided with an outlet 66 incorporating a valve which may operate in the manner of an aerosol valve. Thus, for example, the outlet of this and the previously described embodiments may comprise a central nozzle 68 depression of which relative to the collar 70 operates an internal valve to open a passage leading from the sachet and through the nozzle 68. The device will include a user operable mechanism (not shown) for effecting such depression of the nozzle 68 when desired to allow liquid to be supplied from the sachet to the tip of the nozzle.

The casing parts 54, 56 at one end are formed with recesses 72 which together form a circular opening for receiving the neck of the outlet 66 when the sachet is inserted into the cartridge 50. The casing parts are of semi-cylindrical shape and fit into a cylindrical section of the housing 52. The end of the housing is provided with a removable cap assembly (not shown) including an nozzle piece which, when the cartridge is inserted into the housing, registers with the nozzle of the sachet so that liquid can be supplied to the nozzle piece for electrostatic spraying from the latter when the valve associated with the sachet outlet 66 is open. Electrostatic potential typically of the order of about 15 to 25 kV is applied to the liquid from an HT generator contained within the housing so that liquid emerging at the tip of the nozzle piece is electrostatically charged and is drawn out into a spray by preponderantly electrostatic forces, the liquid being drawn out by the electrostatic field into ligaments which break up into droplets to form the spray.

The application of electrostatic potential to the liquid is effected in the embodiment of FIGS. 5 and 6 by providing one of the casing parts with an electrically conductive path or track 76 which extends from one end of the cartridge to the other to provide electrical connection between the high voltage output of the HT generator and the sachet outlet 66, the latter being of conductive material and being arranged to make electrical contact with the track 76. It is to be understood that the embodiment of FIGS. 5 and 6 may not be suitable for applications where the foam is to be maintained under pre-compression for relatively long periods due to the previously discussed decay characteristics of the foam. This embodiment is typically used in "one-shot" spraying applications where the cartridge is closed up to compress the foam, loaded into the device, operated for a relatively short period of time and then disposed of.

Referring now to FIG. 7, a hand held electrostatic spraying device in accordance with the invention is in the form of a pistol shaped housing 80 having a hand grip 82 and a generally cylindrical main body portion 84. The body portion 84 is fitted with a removable cap 86 which mounts a nozzle piece 88 from which liquid is electrostatically sprayed in use. The cap 86 closes the open end of a cavity 90 which receives the liquid container. In this embodiment, the container is a flexible walled sachet of the form described with reference to FIGS. 3 and 4 and the same reference numerals are used to identify parts which are common to FIG. 7 and FIGS. 3 and 4. The sachet 30 is located between a resilient foam pad 114 adjacent the fixed end wall 40 of the cap 86 and a pad 46 of resiliently deformable material carried by a movable drive plate 42 which is mounted slidably within the cavity 90 and is connected to a piston 91 slidable within the body portion 84. Spring means (not shown) is provided to bias the piston to the position shown in which the pad 46 is not compressed or only compressed to a limited extent.

The piston 91 is constituted by an HT generator for producing from a low voltage source, a high voltage suitable for effecting electrostatic spraying The generator has a high voltage output pole 92 connected to the outlet 66 of the sachet 30 by a flexible lead 94. The low voltage source comprises a battery pack 96 accommodated in the hand grip portion 82. An earth for the circuit is provided via a resistor 98 and a contact 100 exposed for contact with the user's hand.

Operation of the device is controlled by a trigger 102 pivoted at 103 and having a cam portion 104 arranged to bear against the adjacent end of the piston/generator 91 so that, as the trigger is squeezed, the piston is displaced to the left as seen in FIG. 7 thereby moving the drive plate 42 and compressing the sachet 30. In the initial part of trigger movement, the cam 104 is arranged to close a microswitch 106 which completes the circuit to enable the generator to produce a high voltage output at terminal 92 for application to the sachet outlet 66. The initial displacement of the drive plate 42 advances the sachet and compresses the pad 114 which may be less stiff than the pad 46, and the nozzle 108 of the sachet outlet 66 is urged against an abutment surface within the nozzle piece 88 causing the nozzle 108 to be depressed relative to the outlet 66 thereby opening the valve of outlet 66. Thus, initial displacement of the drive plate 42 serves to effect opening of the valve. Continued displacement of the drive plate 42 compresses the sachet to effect dispensing of the liquid at a rate governed by the extent to which the trigger is squeezed.

The liquid emerging through the nozzle 108 enters a passageway 110 extending to the tip of the nozzle piece 88. An electrostatic potential is applied to the tip via the terminal 92, lead 94, outlet 66 and the liquid. The electrostatic potential gradient existing between the tip and surrounding earthed objects and structures draws out the liquid into a spray of electrically charged droplets which, by virtue of their charge, are attracted to any suitably located earthed target in the vicinity. The rate of spraying the liquid can be varied according to the pressure applied by the user to the trigger. If desired, the foam pad 46 may have the characteristics described with reference to FIGS. 2 and 2A where the rate of spraying is required to be relatively constant over at least the major part of the range of movement of the trigger lever 102.

The force exerted on the valved outlet of the sachet during the initial displacement of the drive plate 42 is transmitted via the flange 38 which will be substantially rigid or at least substantially more rigid than the flexible walls of the sachet. The flange 38 may be larger than shown in FIG. 7 and, in some circumstances, the flange may be substantially co-extensive with one wall of the sachet or the sachet may be fabricated with one wall flexible and a second wall substantially rigid or at least substantially more rigid than the flexible wall, the more rigid wall then being used to transmit force from the drive plate 42 to the valved outlet of the sachet.

The pad 114 serves to urge the sachet back to the position shown in FIG. 7 but it will be appreciated that its function may be achieved by some other form of spring.

In the embodiment of FIG. 7, opening of the sachet valve is effected through the agency of the sachet. It may however be desirable to avoid subjecting the sachet to compression until after the valve has been opened. FIG. 8 illustrates one embodiment for implementing such an arrangement. In FIG. 8, certain components are functionally the same as in FIG. 7 and such components are identified by the same reference numerals as used in FIG. 7. The hand grip portion and components accommodated therein of the FIG. 8 embodiment may be generally the same as in FIG. 7 and have therefore been omitted. In this embodiment, the sachet is received within a carrier 112 which is slidably mounted within the main body 84 and has a removable cover 114 which provides a surface 40 which contacts one of the major faces of the sachet 30.

The opposite surface of the sachet is contacted by drive plate 42 through pad 46, the drive plate in this instance being connected to the piston/generator 91 with lost motion in that the piston is slidably received in an enlarged diameter part 116 of a sleeve 118 which is connected to the drive plate 42 and transmits motion from the piston to the drive plate 42 only when the piston has moved into abutment with a shoulder 120 between the enlarged and reduced diameter sections of the sleeve 118. The piston 91 and the carrier 112 are linked by a tension spring 122 so that, when the piston is advanced to the left by operation of the trigger, the piston and the carrier (and hence the sachet) move together for a short distance sufficient to operate the valve of the sachet outlet 66. The valve is spring-loaded to the closed position and the force exerted by the tension spring 122 is therefore selected to be greater than that exerted by the valve spring.

Continued movement of the piston to the left brings the carrier 112 into contact with the cap 86 at which point movement of the carrier 112 is arrested. Further movement of the piston to the left takes up the lost motion in sleeve 118 and causes the drive plate 42 to compress the pad 46 and hence compress the sachet to supply liquid to the tip of the nozzle piece 88 and effect electrostatic spraying in the manner described with reference to FIG. 7. Suitable spring biasing is provided so that, when the trigger is released, the components return to the starting positions shown in FIG. 8.

Referring now to FIGS. 9, 10A and 10B, the device shown comprises a housing 150 having a handgrip portion 152 provided with a user-operable trigger 154 pivoted at 156 and spring-loaded outwardly of the handgrip portion 152 to an inoperative position by unshown spring means. In this embodiment, as illustrated, from the electrical standpoint only the high voltage generator 158 and microswitch 160 are shown, the remaining circuitry being generally similar to that shown in the embodiment of FIG. 7. The trigger 154 is arranged to co-operate with the switch 160 which forms part of the low voltage circuitry associated with the high voltage generator 158, the switch being arranged to be operated in response to initial displacement of the trigger 154 from its inoperative position thereby powering the generator 158. The handgrip portion or the trigger may be provided with a contact (not shown) exposed for engagement with the hand so as to provide a path to earth in use.

At one end, the housing terminates in a removable cap 162 which may have a snap fit or screw-threaded connection with the housing 150. A nozzle 164 projects through the cap 162 and is supplied with liquid from a container 166 within the housing. The container is in the form of a sachet having the same design as described with reference to FIGS. 3 and 4, the valved outlet 168 of the sachet comprising a nozzle portion 170 which fits into the inner end of the nozzle 164. The high voltage output of the generator 158 is electrically connected to a conductive part of the sachet outlet 168 so that high voltage is applied in use to the liquid supplied to the nozzle 164.

The sachet 166 and the generator 158 are received within a carrier 172 which is slidably mounted within the housing 150 for movement towards and away from the cap 162, movement towards the cap occuring in response to squeezing of the trigger 154 and movement in the opposite direction being effected, on release of the trigger, by unshown spring means which may, for instance, act between the cap 162 and a closure 174 located at the forward end of the carrier 172. This spring means may also be effective to return the trigger to its inoperative position in which the switch 160 is open and the generator 158 is de-energised.

As shown more clearly in FIGS. 10A and 10B, the carrier 172 has a double-sleeved configuration comprising an inner sleeve 176 and an outer sleeve 178 which are united at one end of the carrier by springy webs 180 which permit the inner sleeve to move axially relative to the outer sleeve. In FIG. 10A, the carrier is shown in its unstressed condition in which the inner sleeve projects slightly beyond the outer sleeve. In FIG. 10B, the carrier is shown in the condition obtaining when the inner sleeve is displaced inwardly relative to the outer sleeve, resulting in stressing of the webs 180 which tend to bias the inner sleeve back to the position shown in FIG. 10A. The inner sleeve 176 forms a housing for the generator 158 and also receives the microswitch 160. The generator and the microswitch are securely fixed within the inner sleeve, for example by means of potting resin which may fill the space between the microswitch 160 and the generator 158 and also encapsulate electrical leads (not shown) connecting the generator to the microswitch and to a battery pack (not shown). The inner sleeve 176 is shorter in length than the outer sleeve 172 and its forward end has a drive plate 179 secured thereto in spaced relation to closure 174 which closes the forward end of the outer sleeve. The closure plate 174 is releasably attached to the carrier and may be screw-threadedly connected to the outer sleeve 178, for instance by screw threads provided on an annular flange 182 on the closure 174 and on the inner periphery of the outer sleeve 178.

The inwardly presented face of the closure 174 is formed with an annular retaining flange 184 defining a cavity for reception of the sachet 166, the closure 174 being formed with an opening in which the valved outlet 168 of the sachet is engaged so that the outlet is captive with the closure 174. A foam pad 186 is interposed between the sachet and the drive plate 179 and may either be secured to the drive plate 179 and received within the cavity defined by the flange 184 or the pad 186 may be separate from the drive plate 179 and housed within the cavity If desired, a layer of resiliently deformable foam material may also be provided between the sachet and the closure 172 (in similar fashion to the embodiment of FIG. 7). Forward movement of the carrier 172 is limited by stops 188 on the cap 162.

When the trigger 154 is in its inoperative position, the carrier 172 is shifted to the right, the closure 174 is spaced from the stops 188 and the inner sleeve 176 projects outwardly beyond the outer sleeve 178 as shown in FIG. 10A. In these circumstances, the nozzle portion 170 of the sachet 166 is extended with consequent closure of the valve and the microswitch actuator 190 is also extended so that the microswitch is open and the generator is de-energised. Upon squeezing of the trigger 154, the initial displacement of the trigger depresses the microswitch actuator 190 via lever arm 192 to close the switch and energise the generator 158. The webs 180 are so designed that, at this point, they provide sufficient spring force to allow continued displacement of the trigger to move the carrier as a unit, by contact between the actuator 190 and the lever arm 192, towards the cap 162 causing the nozzle portion 170 to depress in the manner of an aerosol valve thereby opening the valve to permit supply of liquid from the sachet 166 to the nozzle 164. Axial movement of the carrier continues until the closure 174 abuts the stops 188 at which point continued displacement of the trigger overcomes the spring resistance offered by the webs 180 and is translated into inward movement of the inner sleeve 176 relative to the outer sleeve 178 (as shown in FIG. 9). Such relative movement serves to compress the pad 186 with consequent compression of the sachet 166 and supply of liquid to the nozzle 164 for electrostatic spraying.

When the trigger 154 is released, the various components restore to the condition described above prior to operation of the trigger. If the device is required to produce a relatively uniform rate of spraying irrespective of how forcibly the device is operated by the user, the foam pad may be of the type described with references to FIGS. 2 and 2A. Where the device is required to produce more than one relatively constant spraying rate, the pad 186 may be of the composite type described earlier.

In the latter event, the device may incorporate some form of indicator to enable the user to control the extent of lever displacement in order to achieve the desired spraying rat. For instance, the device may be provided with a position sensor or sensors for detecting displacement of the trigger from its inoperative position and circuitry for visually indicating when the trigger has been displaced sufficiently to place the foam pad in compression to a level corresponding to each of the plateau regions D1 and D2 shown in FIG. 2A. Thus, for example, displacement of the trigger 154 may be related to the plateau regions by means of light emitting diodes (as depicted by reference numerals 194) provided on the housing so that, by appropriate trigger control, the user can cause a particular LED to be energised according to the rate of spraying required. Thus, in one embodiment, the device may have two levels of operation, corresponding to higher and lower relatively constant spraying rates, and the LED's may be arranged so that one is energised when the trigger is partially depressed to give a lower spraying rate and the other is energised when the trigger is depressed to a greater extent.

Referring now to FIG. 11, in this embodiment of the invention, the device incorporates an actuator which eliminates the need for a pistol-type configuration. The device compress a housing 200 of generally tubular configuration terminating at one end in a generally hemispherical portion 202 through which a spraying nozzle 204 projects, the nozzle being fixed relative to the portion 202. The portion 202 may be integral with the housing 200 or it may be detachable; for example, it may be connected to the main body of the housing by snap fit or by screw threaded engagement. The opposite end of the housing is closed by a removable cap 206 which may also make snap fit or screw threaded engagement with the main body of the housing. The removable cap 206 allows access to the interior of the housing for the purpose of fitting/replacement of a low voltage battery source 208 within that end of the housing 200.

Along one side thereof, the housing is provided with an opening which is normally closed by a cover 210. The cover 210 may be connected to the housing in various ways to allow the cover to be removed, or moved to an open position, so as to allow access to the interior of the housing at a location midway between its ends. A high voltage generator 212 is fastened to the cover 210 and, in addition to acting as a source of high voltage (powered by battery source 208), the generator 212 also provides a support surface 214 for a sachet 216 of liquid to be dispensed by the device, eg. a personal care fluid such as a deodorant, fragrance or hair spray.

The cover 210 in the illustrated embodiment is hingedly connected to the main body of the housing 200 by hinge connection 218 so that the cover can be moved (together with the generator 212) in the direction A from the closed position shown to an open position in which the sachet 216 is exposed for removal and replacement. In the closed position, one end 220 of the cover engages with the main body of the housing and may be fastened thereto by a releasable catch or the like (not shown). Electrical connections between the generator 212 and components on the low voltage side of the electrical circuitry are made through contact sets 222, 224 provided on the cover portion 220 and the portion of the housing with which the cover portion engages when the cover 210 is in the closed position, the terminals of the generator being connected to the contacts 222 by for example conductive tracks (not shown) on the inside face of the cover 210. It will be seen that opening of the cover 210 automatically separates the contact sets 222, 224 thereby disconnecting the generator 212 from the low voltage power source. In FIG. 11, only the contact set for connection of one input terminal of the generator to the battery source is shown; a similar contact set (not shown) is provided for connection of the generator to a switch 254 via a flexible lead.

The outlet of the sachet 216 is connected by flexible pipe 226 to a valve assembly 230 of the aerosol valve type. The valve assembly 230 includes a nozzle portion 232 which is inserted into one the inner end of the nozzle in a manner similar to the embodiments of FIGS. 7 to 9 such that axial displacement of the collar portion 234 relative to the nozzle portion 232 displaces the latter inwardly of the collar against the action of outward spring biassing and is effective to open the valve to permit feed of liquid from the sachet 216 through pipe 226 to the nozzle 204 for spraying from the tip thereof. The sachet 216 is conveniently manufactured with an outlet which is sealed by a foil through which the pipe 226 can be inserted in order to communicate the interior of the sachet with the nozzle 204.

The housing 200 incorporates an actuator 236 which is displaceable laterally of the longitudinal axis of the housing so as to apply compression to the sachet 216 through the agency of a foam pad 238. The actuator 236 is mounted by pairs of slides 240 disposed within the housing 200 (only one of each pair being shown) and having slots with which guide pins 242 carried by the actuator 236 are engaged. When the device is held in the palm of the hand and squeezed, the actuator 236 can be displaced from the inoperative position shown towards the generator 212 thereby compressing the foam pad 238 and compressively loading the sachet 216. The resilience of the foam pad 238 may be sufficient to restore the actuator 236 to the position shown when the squeezing action is discontinued or a separate spring means be arranged to bias the actuator 236 to the inoperative position.

The actuator 236 is arranged to cooperate with a cam follower 244 mounted within the housing by pivot pin 248 comprising a pair of lobes 246 (only one of which is shown) which straddle the pipe 226, the cam follower 244 being spring-loaded to the position shown by unshown spring means. When the actuator 236 is displaced inwardly by squeezing action on the part of the user, after taking up lost motion, cam portion 250 contacts the follower 246 and deflects it clockwise so as to displace the collar 234 of the valve assembly 230 relative to the nozzle portion 204 thereby opening the valve to permit dispensing of liquid from the sachet 216. Where the device is intended to dispense at a relatively constant rate, the degree of lost motion to be taken up before the cam portion 250 contacts the cam follower 246 may be such that the foam pad 238 is compressed to a point corresponding to a plateau region as previously described in connection with FIGS. 2 and 2A.

The high voltage output of the generator 212 is connected to the valve assembly by lead 252 so that electrical potential is applied to the liquid at that point in its feed path. Thus, the liquid emerging at the tip of the nozzle 204 is electrically charged and a spray of fine droplets is produced as a result of the liquid being drawn out, preponderantly by the electrical field gradient existing between the nozzle tip and the surroundings (usually at earth potential), into ligaments which thereafter break up into electrically charged droplets. Switching on of the generator 212 is effected by a switch 254 located on the actuator 236 and so arranged that the switch energises the low voltage circuitry to power the generator in response to the squeezing action applied by the user. The switch 254 may for example be in the form of a membrane switch and is connected to the battery source by flexible lead 258 and to the low voltage input side of the generator 212 by a flexible lead (not shown) which will be connected to the generator through a contact set such as that depicted by reference numerals 222, 224. An earth return path may be provided by contact of the users hand with a suitable contact on the actuator.

Thus, in operation, the application of a squeezing action to the housing 200, when held in the hand, displaces the actuator 236 to open the valve assembly 230 and compress the sachet 216 and also operates the switch 254 to power the generator 212 so that high voltage is applied to the liquid fed to the nozzle 204 as a result of compression of the sachet. When the contents of the sachet are depleted, the empty sachet can be readily replaced by a fresh one by opening cover 210, pulling the sachet away from the pipe 226, connecting the pipe 226 to the fresh sachet by using it to pierce through the foil seal at the sachet outlet, positioning the fresh sachet in the housing and closing the cover 210.

We claim:

1. A device for electrostatically spraying fluids, comprising a housing for receiving a flexible liquid-containing container, said container being of the type which is operable to dispense its contents in response to being compressed, a nozzle from which the liquid is to be sprayed in use, means for compressing the container to feed liquid to the nozzle and high voltage means for applying electrostatic potential to the liquid such that the liquid issues from the device in the form of an electrically charged spray, said means for compressing the container comprising a pad of resiliently deformable material for bearing against the container, and means for deforming said material to subject the container to compressive loading.

2. A device as claimed in claim 1 in which said resiliently deformable material has a pressure versus deformation curve which exhibits a plateau region over which the pressure exerted by said pad varies to a lesser extent per unit deformation in pad thickness than over adjacent regions of the curve, and in which said deforming means is arranged to compress said pad over a deformation range encompassing said plateau region.

3. A device as claimed in claim 2 in which said deforming means is arranged to pre-compress said pad such that said pad is deformed to an extent corresponding to, or proximate, one extremity of said plateau region whereby, as said container empties, said pad expands but remains compressed to an extent within said plateau region at least until the container is near empty.

4. A device as claimed in claim 3 in which a casing is provided which comprises a pair of casing parts which can be brought together to enclose said container therebetween, at least one of said casing parts being provided with said pad of resiliently deformable material, at least one of said pads being pre-compressed on enclosing said container within said casing parts.

5. A device as claimed in claim 4 in which said pad bears directly against said container in use.

6. A device as claimed in claim 2 in which said deforming means has a user-displaceable member for effecting compression of said pad.

7. A device as claimed in claim 6 which said member has a range of displacement such that, over at least a major part of its displacement range, said pad remains compressed within said plateau region.

8. A device as claimed in claim 2 in which the resiliently deformable material has a foam material having an open cell structure.

9. A device as claimed in claim 1 in which said deforming means has a user-displaceable member for effecting compression of said pad.

10. A device as claimed in claim 9 in which said user-displaceable member is controllable to vary the extent of deformation of aid pad.

11. A device as claimed in claim 1 having compressible container located within said housing.

12. The combination of claim 11 in which said container comprises a sachet with a valve-controlled outlet.

13. The combination of claim 12 in which said container comprises at least one flexible wall.

14. A device as claimed in claim 13 in which said sachet comprises a pair of confronting walls at least one of which is flexible, joined together around the periphery of said sachet and in which said outlet is provided in a first of said walls.

15. A device as claimed in claim 14 in which said sachet is located with a second one of said walls presented for engagement with said pad.

16. A device for electrostatically spraying liquids comprising a housing, a container in the form of a flexible liquid-containing sachet housed within said housing and having a valve-controlled outlet, a nozzle connected to the outlet of said sachet and from which the liquid is to be sprayed in use, means for compressing said sachet to feed liquid to the nozzle and high voltage means for applying electrostatic potential to the liquid such that the liquid issues from the device in the form of an electrically charged spray, said means for compressing said sachet comprising a user-operable member mounted on said housing and means for translating operation of said member into compression of said sachet, said translating means comprising a drive plate and a pad of resiliently deformable material interposed between said drive plate and said sachet whereby operation of said member effects displacement of said drive plate thereby deforming said pad and applying compressive loading to said sachet through the agency of said pad.

17. A device as claimed in claim 16 in which said sachet comprises a pair of confronting walls, at least one of which is flexible, joined together around the periphery of said sachet and in which said outlet is provided in a first one of said walls.

18. A device as claimed in claim 17 in which said sachet is located with a second one of said walls presented for engagement with said pad.

19. A device as claimed in claim 16 in which said valve-controlled outlet of said sachet comprises a collar and a movable nozzle member such that said valve controlling said outlet of said sachet is opened in response to movement of said nozzle member relative to the collar, said translating means including lost motion means and being so arranged that initial operation of the user-operable member effects translation movement of said sachet and the collar relative to the nozzle member of the sachet to open the valve and continued operation of the user-operable member thereafter becomes effective to compress the sachet to effect supply to liquid to the advice nozzle.

20. A device as claimed in claim 19 in which said high voltage means is connected to said sachet outlet whereby the high potential is applied to the liquid through the agency of the sachet outlet.

21. A device for electrostatically spraying liquids, comprising a housing for receiving a flexible liquid-containing container, the container being of the type which is operable to dispense its contents in response to being compressed, a nozzle from which the liquid is to be sprayed in use, means for compressing the container to feed liquid to the nozzle, and high voltage means for applying electrostatic potential to the liquid such that the liquid issues from the device in the form of an electrically charged spray, said compressing means comprising a user-displaceable member and means for non-linearly translating displacement into compressive force with a compressive force versus displacement characteristic having a plateau region over which the compressive force generated is relatively constant in comparison with adjacent regions whereby a relatively constant spraying rate can be obtained.

22. A device as claimed in claim 21 in which said user-displaceable member has a predetermined range of displacement and in which the arrangement is such that said translating means operates within said plateau region for at least a major part of the displacement of said member over said predetermined range.

23. A device as claimed in claim 21 in which said translating means has a compressive force versus displacement characteristic with at least two plateau regions as aforesaid whereby at least two relatively constant rates of spraying can be obtained.

24. A device as claimed in claim 23 including means for providing an indication relating displacement of said user operable member to spraying rate whereby the user can control said member to derive a selected relatively constant spraying rate.

25. A device as claimed in any one of claims 4, 16 or 24, in which said compressing means is operable to said container axially with respect to the outlet of the container

26. A device as in claims 4, 16 or 24, in which said compressing means is operable to compress said container transversely with respect to the outlet of the container.

27. A device as claimed in claim 26 in which said housing is of elongated configuration suitable for hand held use and has a cavity for reception of said container such that major surfaces of said container extend substantially axially from the housing, said compressing means including a user-operable actuator which is displaceable transversely of the axis of elongation of said housing to effect compressive loading of said container.

28. A device as in claim 4, 16 or 24 in which said housing is of generally cylindrical configuration being adapted to be held in the hand by closing the hand around its periphery.

29. A device as claimed in claim 28 in which said housing is of elongated configuration suitable for hand held use and has a cavity for reception of said container such that major surfaces of said container extend substantially axially from the housing, said compressing means including a user-operable actuator which is displaceable transversely of the axis of elongation of said housing to effect compressive loading of said container.

30. A device for electrostatically spraying liquids, comprising:

a housing;

a nozzle projecting from said housing;

a flexible liquid storage container in the form of a compressible sachet having a valve-controlled outlet, said container being removably located within said housing with said valve-controlled outlet connected to said nozzle;

high voltage generating means located within said housing for applying high potential to the liquid so that the liquid emerging from said nozzle is dispensed from said nozzle in the form of an electrostatically charged spray; and means for compressing said sachet and opening said valve to effect feed of liquid from said sachet to said nozzle, said compressing means comprising a user-displaceable member and means for non-linearly translating displacement into compressive force with a compressive force versus displacement curve having a plateau region over which variation in the compressive force applied varies to a lesser extent per unit displacement than over adjacent regions of the curve, said user-displaceable member having a predetermined range of displacement and the arrangement being such that said translating means operates within said plateau region for at least a major part of the displacement of said member over said predetermined range.

31. A device as claimed in claim 30 in which said translating means comprises a pad of resiliently deformable material interposed between said sachet and said user-displaceable member.

32. A device as claimed in claim 30 in which said sachet comprises a pair of major wall portions and in which said user-displaceable member is operable to apply compressive force to said sachet in a direction generally perpendicular to said major wall portions.

33. A device as claimed in claim 32 in which said valve-controlled outlet of said sachet is conductive and said high potential is applied to the liquid via said outlet.

* * * * *